United States Patent [19]

Stull

[11] 4,377,248

[45] Mar. 22, 1983

[54] DISPENSING CAP CONSTRUCTION

[76] Inventor: Morton B. Stull, Split Rock Rd., Boonton Township, Morris County, N.J. 07005

[21] Appl. No.: 223,542

[22] Filed: Jan. 9, 1981

[51] Int. Cl.[3] ..... B67D 3/00

[52] U.S. Cl. ..... 222/543; 222/546; 215/306

[58] Field of Search ..... 222/543, 546, 563, 570, 222/571, 556; 220/375; 215/306

[56] References Cited

U.S. PATENT DOCUMENTS

| | | | |
|---|---|---|---|
| 3,240,405 | 3/1966 | Abbott | 222/543 |
| 4,127,221 | 11/1978 | Vere | 222/543 |
| 4,128,151 | 11/1978 | Hazard | 222/543 |

FOREIGN PATENT DOCUMENTS

| | | | |
|---|---|---|---|
| 258012 | 5/1963 | Australia | 222/543 |

*Primary Examiner*—H. Grant Skaggs
*Attorney, Agent, or Firm*—H. Gibner Lehmann; K. Gibner Lehmann

[57] ABSTRACT

A dispensing cap construction for hand-held dispensers, comprising a tubular cap body with a top discharge opening and a closure cap adapted to mount on the cap body by beads of a flexible hinge. The body has an upstanding spout which surrounds the opening and which is arranged to receive a depending pin disposed on the underside of the closure cap. There are provided on the cap body and closure cap, cooperable detent beads which yieldably hold the closure cap in an assembled, sealing position. The length of the pin on the closure cap is sufficiently great such that engagement with a guide wall portion of the spout occurs prior to the engagement of the detent beads. The arrangement is such that proper alignment and centering of the cap on the body will occur, facilitating proper closing of the dispenser. In addition, the length of the pin is such that it extends a substantial distance past the surrounding wall adjacent the discharge opening, thereby tending to break up accumulated product and preventing any residue from hardening over the opening and blocking the same.

7 Claims, 5 Drawing Figures

DISPENSING CAP CONSTRUCTION

BACKGROUND

This invention relates generally to dispensing closures for hand-held dispensers, and more particularly to devices of the type incorporating a captive closure cap which is hingedly connected to a tubular cap body.

In the past, a number of different closure constructions have been proposed and produced. With most prior arrangements, a number of problems arose, especially after extended periods of use, and with certain types of liquid or cream products. In almost all prior devices, there was a likelihood of the product accumulating in the vicinity of the discharge opening, especially after the first few dispensing operations. While the accumulation from one or two uses was generally only moderate, the product or residue hardened in time, tending to diminish the size of the discharge opening, or even completely blocking off the same. Even where blockage did not occur, a general deterioration of the dispensing function occurred. As the initial residue hardened, additional product would tend to adhere to the hardened material, thereafter solidifying, and making the degree of build-up even worse.

In some prior constructions, product build-up in the vicinity of a discharge opening has been minimized by incorporating a sealing plug in the closure cap, the plug functioning to dislodge any residue before it hardened. A typical cap is shown in U.S. Pat. No. 3,927,805 dated Dec. 23, 1975.

One of the problems with such a plug involved choosing a size which was sufficiently large so as to properly seal the discharge opening, while at the same time not causing undue restriction of movement of the closure cap between the assembled and discharge positions. In the case of a hinged closure cap, there has clearly existed a problem in that with a relatively short hinge, the axis of the closure cap was skewed with respect to the axis of the body at the time that there occurred engagement of the two parts. Accordingly, a pin on the underside of the closure cap had to enter the discharge opening at a substantial angle. If the proposed design was such that the pin diameter was only slightly less than that of the discharge opening, interference would result from such an angled entry. On the other hand, with a significantly smaller pin diameter, the adequacy of the seal was sometimes jeopardized.

In addition, with other types of hinged closures, it was difficult or awkward for the consumer to re-close the container, especially in the presence of dried or hardened product residue. Under such circumstances, the closure cap might not properly seat on the body, thus defeating the closure function of the dispenser.

Still other prior designs have suffered from poor sealing characteristics, resulting in leakage of the product during storage or shipping. In addition, with some prior constructions it was not possible to dispense the last remaining portions of the product, especially where relatively viscous liquids or creams were being used. This, of course, represented unnecessary waste and added expense to the consumer.

SUMMARY

The above disadvantages and drawbacks of prior dispensing cap arrangements are obviated by the present invention which has for an object the provision of a novel and improved dispensing cap which is simple in construction, reliable in operation, and which can be easily molded in simple mold cavities.

A related object is the provision of a closure construction of the type incorporating a hinged closure cap, which is more convenient for the consumer to use in that it minimizes problems with drying and crusting of product, and also facilitates the opening and resealing of the closure cap. There is prevented the accumulation and hardening of residual product in the vicinity of the discharge opening; following use, any remaining product is forced down through the opening as the closure cap is re-assembled to the cap body.

Still another object is the provision of a closure construction as above, incorporating a special guide which facilitates proper closing of the closure cap, substantially prior to the engagement of cooperable detent means on the cap body and closure cap.

Yet another object of the invention is the provision of a closure construction incorporating a piercing member which effectively breaks through any solidified or dried product, and thus operates to maintain the discharge opening clear at all times.

The above objects are accomplished by the provision of a dispensing cap construction for hand-held dispensers, comprising a tubular cap body having a top discharge opening, a closure cap adapted to mount on the cap body, and a flexible hinge structure connecting the body and closure cap for holding the latter captive while enabling it to be swung from a sealing position closing off the opening of the body, to a discharge position removed from the opening. Cooperable yieldable detent means are provided on the cap body and cap, for yieldably holding the latter in its mounted position. The body has an upstanding spout of annular configuration surrounding the opening, and the cap has a depending pin which is received in the spout so as to force any residual product from the discharge opening back into the dispenser, following use. The spout has a sloping inner guide wall which centers the pin and guides the cap as it is swung from its discharge position to its sealing position. The length of the pin is sufficiently great to cause positive engagement of the same with the guide wall of the spout prior to the occurrence of any substantial engagement of the detent means, thereby to facilitate proper alignment and centering of the closure cap on the body at the time when the engagement of the detent means occurs.

The objects are further accomplished by the provision of a dispensing cap construction of the type having a closure cap hingedly connected to a cap body by means of a flexible web, wherein the closure cap carries at its underside, a depending pin which is receivable in a discharge opening of the cap body. The pin has a non-uniform cross-section and is of reduced diameter at its tip. The cross dimension of the discharge opening exceeds the cross dimension of the tip of the pin whereby the latter can enter the opening at a slight angle with respect to the axis of the body without encountering any substantial interference during initial engagement of the pin with the walls of the opening. Also, the pin is of increased cross dimension at a point removed from the tip so as to form a closer fit in the opening as the closure cap becomes more fully seated, as in its sealing position.

The objects are still further accomplished by a dispenser cap construction of the type which screws onto a bottle and is intended to be permanently retained thereon, the cap construction having a closure cap held captive on a cap body by means of a flexible hinge web, wherein the cap body has a transverse top wall with a discharge opening and a sloping drain surface at its underside, for channeling liquid from the dispenser and the inner walls of the cap body toward the discharge opening when the dispenser is inverted, thereby to enable virtually complete emptying as the dispenser becomes depleted. There is thus greatly minimized product waste, in that there exist no pockets or ledges in which the substance being dispensed can become trapped. The closure cap also has a product-dislodging pin which is secured to its underside, receivable in the discharge opening when the closure cap is swung to the fully assembled position.

By the above organizations, there is provided a greatly improved dispenser which is more convenient for the consumer to use, and which substantially reduces the waste that was associated with many prior constructions. This is especially true where the substance being dispensed is viscous, that is, where cream-type products or heavy lotions of one type or another are being used.

The particular dispensing cap construction that is illustrated is capable of being molded as a single, integral piece, thereby greatly reducing the manufacturing cost and eliminating time that would otherwise be required to effect assembly of the finished dispenser.

Other features and advantages will hereinafter appear.

In the drawings, illustrating a preferred embodiment of the invention:

Figure 1:
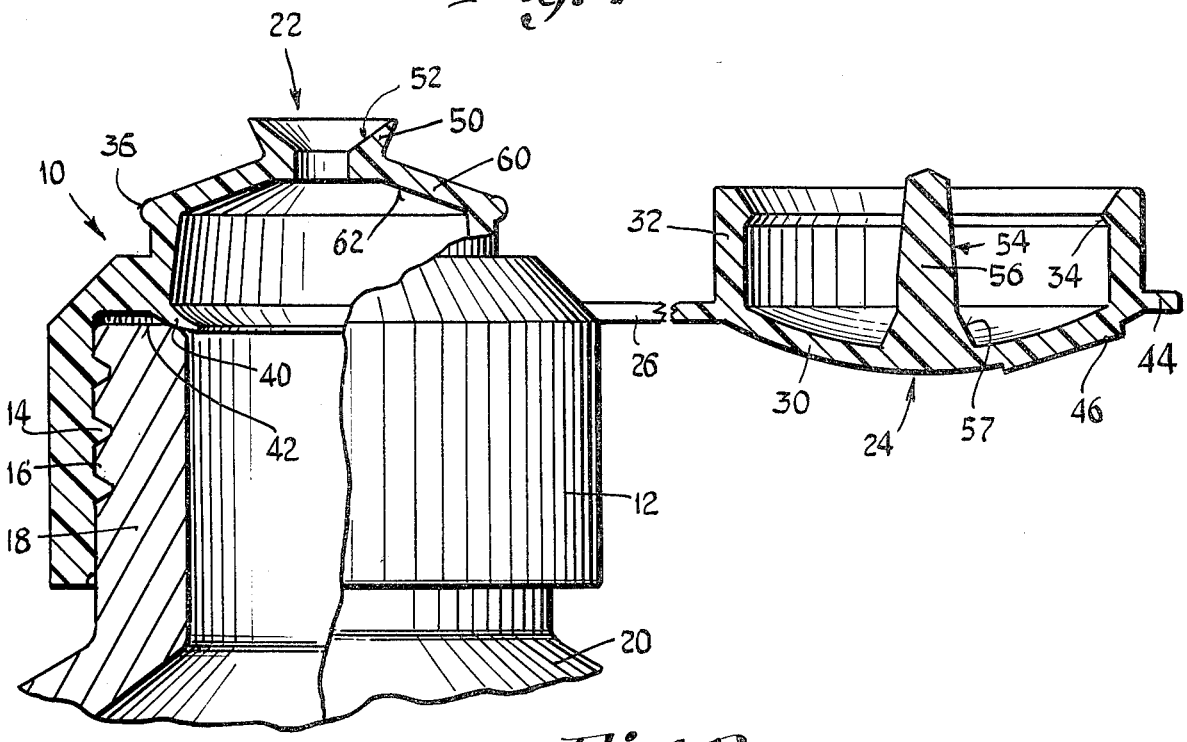
FIG. 1 is a vertical section of a dispensing container employing the improved dispensing construction of the present invention, shown in the open or product-discharging position.
Figure 2:
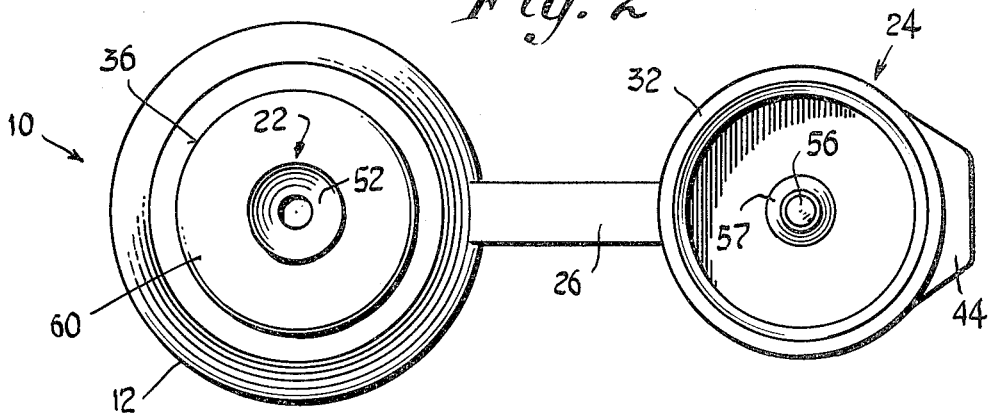
FIG. 2 is a top plan view of the dispensing cap construction of FIG. 1.
Figure 3:
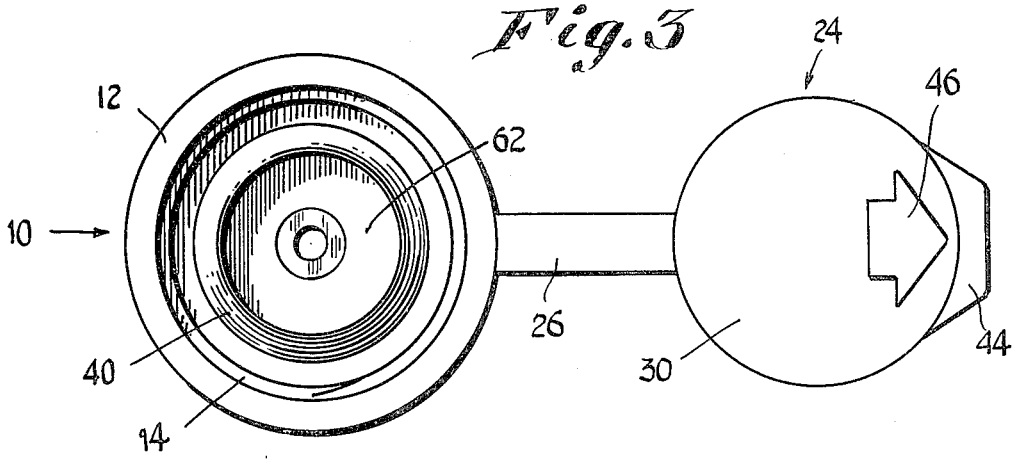
FIG. 3 is a bottom plan view of the construction of FIGS. 1 and 2.

FIGS. 1–5 illustrate a dispensing cap construction for handheld dispensers, generally designated by the numeral 10 and comprising tubular cap body 12 having internal threads 14 which are adapted to engage cooperable threads 16 on the neck 18 of a container 20. The cap body has a top discharge opening 22 by which the contents of the container are dispensed. A closure cap 24 is provided, held captive on the cap body 12 by means of a flexible hinge structure 26. The latter is constituted as a relatively thin web and enables the closure cap 24 to be swung from a first or open position, removed from the body 12, and a second, sealing or closed position, closing off the opening 22. The first and second positions are illustrated respectively in FIGS. 1 and 4.

The closure cap 24 has a transverse wall 30, and a depending skirt 32. Disposed on the inner surface of the skirt 32 is an annular bead 34 which is intended to bypass a cooperable bead 36 on the cap body 12, as the closure cap is swung between its open and closed positions. The beads 34, 36 constitute cooperable yieldable detent means on the cap body and closure cap, tending to hold the latter in its closed or mounted position.

The cap body 12 has a thin, deformable sealing skirt 40 of annular configuration, for engagement with the lip 42 of the neck 18 of the container 20. The skirt 40, being resilient, can flatten a limited extent as illustrated in FIG. 1, so as to provide a seal between the body 12 and neck 18, thereby preventing leakage of product from the container interior past the threads 14, 16.

Referring again to FIG. 1, the closure cap 24 has a lifting edge 44 by which it can be pried off the body 12, by the nail of the user. A molded raised arrow 46 can be provided, to indicate to the user the location of the lifting edge 44, when viewed from the top of the closure cap 24, as in FIG. 3.

In accordance with the present invention, there are provided on the cap body 12 and closure cap 24 cooperable structures which are adapted to engage one another as the closure cap 24 is swung toward its closed position, prior to any substantial engagement of the detent beads 34, 36, thereby to provide a guide for the closure cap 24 and facilitate proper alignment and centering of the same at the time that engagement of the detent beads occurs. In accomplishing the guiding, an upstanding pouring spout 50 is provided, upwardly and outwardly flared as shown, and having a funnel-like inner guide surface 52. The surface 52 can be of conical configuration, although this is not necessary in order to achieve the guide function. Disposed on the underside of the closure cap 24 is a depending pin 54 having a length which is sufficient to enable it to arrive at or engage the surface 52 prior to substantial engagement or contact of the beads 34, 36. Also, by the present invention, the pin 54 can be of tapered configuration or other non-uniform cross-section, having a reduced dimension adjacent its tip. The cross-dimension of the pin increases nearer its point of attachment with the wall 30. This area of increased dimension is indicated by the numeral 56. Also, in order to strengthen the pin 54, a small reinforcing land or fillet 57 is provided, as shown in FIG. 1.

Figure 4:
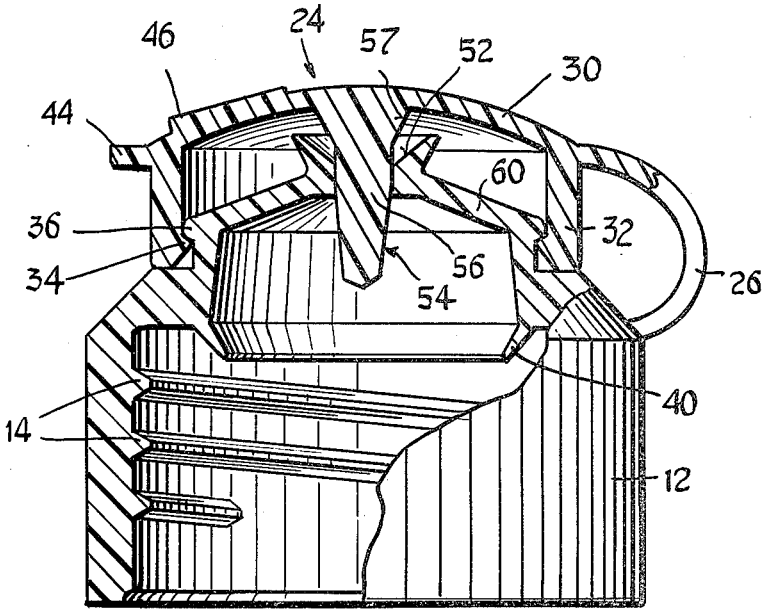
FIG. 4 is a vertical section of the construction of FIGS. 1–3, shown in the closed, sealing position.
Figure 5:
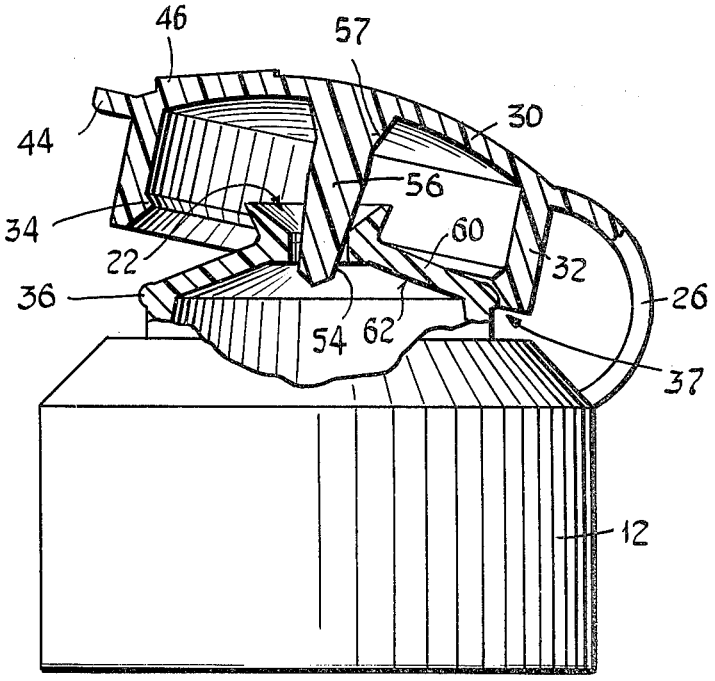
FIG. 5 is a view like FIG. 4, except showing the closure cap being swung from the open or discharge position, toward the closed, sealing position, and particularly illustrating the engagement of a depending pin that is carried by the closure cap, with the guide wall of an upstanding spout on the cap body.

By the above arrangement, as the closure cap 24 is swung from the open position of FIG. 1 to the sealing position of FIG. 4, the pin 54 is the first part of the closure cap to engage the cap body 12, in particular, the guide surface 52 of the spout 50. Continued movement of the closure cap 24 will have the effect of automatically centering the same with respect to the body, such that as the engagement of the beads 34 and 36 occurs, the cap will be in a position wherein a smooth by-pass of the beads can occur, without any substantial interference occurring. In such a way, the beads are not relied upon to provide any substantial centering function for the closure cap, since this function is already accomplished by the action of the pin which has entered the spout. Such entry is illustrated in FIG. 5, which shows the engagement that has occurred between the pin and the walls of the spout, prior to the engagement of the beads 34, 36. The space that exists between the beads 34, 36 adjacent the location of the web 26 is indicated by the numeral 37 in FIG. 5. Accordingly, easier operation is realized, and less problems with proper assembly are likely to be encountered by the consumer.

The special tapered configuration of the pin 54 provides the following advantages, in addition to the guiding function noted above. During assembly of the cap 24 to the body 12, the pin 54 enters the discharge opening 22 at an an angle, as shown in FIG. 5. Since the dimension of the tip of the pin is less than the dimension of the opening 22, binding or interference which would normally take place, does not occur. As the insertion of the pin 54 progresses, the angle it makes with the axis of the body 12 lessens, such that when the larger cross-section portion 56 of the pin enters the opening 22, little or no interference will be encountered. At the same time, this larger portion 56 tends to force any residual product from the opening 22 and in a downward direction, back into the container. Also, this portion forms a relatively tighter fit with the opening 22 to improve the seal characteristics. Thus by merely re-assembling the closure cap, there is virtually complete removal of any undispensed product from the vicinity of the opening 22, all without interference between the pin 54 and the cylindrical wall of the opening.

Further in accordance with the invention, the cap body 12 has a transverse top wall 60 providing a sloping, funnel-like undersurface 62 constituting a drain surface, such that when the dispenser 10 is inverted, any residual product occupying the area adjacent the inner surface of the neck 18 as well as any residue clinging to the inner walls of the cap body 12 will be channeled toward the dispenser opening 22. It can be seen in FIG. 1 that there exist no ledges or pockets in which the product being dispensed can become trapped, when the dispenser is inverted. There is thus minimized unnecessary waste, since complete emptying is possible.

Also, by the invention the depending pin 54 is of sufficient length to enable it to extend a substantial distance past the undersurface 62 of the wall 60 when the closure cap 24 is swung to its sealing position. The degree of projection of the pin past this undersurface 62 is clearly illustrated in FIG. 4. Such an arrangement has been found to be very effective in breaking through and dislodging product accumulation in the vicinity of the discharge opening as well as any residue tending to cling to the portions of the undersurface 62 immediately surrounding the opening. There is thus minimized the possibility of such product solidifying, or crusting over the opening, and making subsequent dispensing operations difficult or impossible. In addition, any product which does tend to cling to the pin 54 is readily dislodged therefrom, the next time that the closure cap 24 is removed, as can be readily understood.

From the above it can be seen that I have provided a novel and improved dispensing cap construction which is simple in its structure and especially easy for the consumer to use. Problems associated with crusting and solidifying of the liquid product are largely eliminated by the provision of the sloping surfaces 52, 62, and the product-dislodging pin 54. Such an arrangement results in reduced product waste, and smoother and more reliable operation over the intended lifetime of the dispenser.

In addition to the advantages noted above, the present construction has the inherent feature of enabling a rapid filling of the dispenser by virtue of the screw-type assembly. As can be readily understood, the containers 20 are first filled with the product intended to be dispensed, and thereafter the cap body and closure cap installed on the containers, preferably by automatic capping equipment. These operations can be streamlined, in order to reduce complexity, and manufacturing expense.

Each and every one of the appended claims defines a distinct aspect of the invention, and accordingly each claim is to be treated in this manner when examined in view of the prior art, in any determination of novelty or validity.

Variations and modifications are possible without departing from the spirit of the invention.

I claim:

1. A molded plastic dispensing cap construction for hand-held dispensers, comprising in combination:

(a) a tubular cap body of yieldable plastic substance, comprising a dome-shaped top wall having a pouring spout and an annular outer peripheral portion provided with an annular detent bead located below the pouring spout and at the base of the dome-shaped top wall, and having a top discharge opening at said pouring spout in said top wall, (b) a cup-shaped captive closure cap of yieldable plastic substance, adapted to be mounted atop said cap body, (c) a yieldable detent bead in the side wall of the closure cap, cooperable with the annular bead on the top wall of the cap body to yieldably hold the closure cap in mounted position on the body, said beads being adapted to by-pass and be forced past one another when the closure cap is assembled to or removed from the cap body, (d) a flexible integral hinge structure connecting said cap body and closure cap, for holding the latter captive while enabling it to be swung from a sealing position closing off the discharge opening of the cap body, to a discharge position wherein all parts of the closure cap are removed from and out of contact with the cap body, (e) cooperable centering means on the closure cap and cap body, rendered operable as the closure cap is swung from the discharge position to the sealing position, for accurately aligning the detent bead of the closure cap with that of the cap body as the cap is being swung to its sealing position, said centering means becoming operative prior to engagement of any parts of the closure cap with any parts of the cap body, (f) said centering means comprising said pouring spout on the cap body, surrounding said discharge opening and having a sloping inner guide wall of funnel-like configuration, and a depending sealing closure pin on the underside of the closure cap, adapted to be received in the pouring spout and to be guided and centered thereby, (g) said pin forcing any residual product from the discharge opening back into the dispenser after use of the cap construction, (h) the length of said pin being sufficiently great to cause positive engagement of the same with the funnel-like guide wall of the spout prior to engagement of any other parts of the cap body and closure cap, thereby to facilitate proper alignment and centering of the closure cap on the body at the time that engagement of said annular detent beads is intended to occur, (i) said pin having a stiffening fillet where it joins the underside of the closure cap, thereby to strengthen the pin and thus improve the centering function thereof.

2. The invention as defined in claim 1, wherein:

(a) said spout is upwardly and outwardly flared to provide a dripless characteristic.

3. The invention as defined in claim 1, wherein:

(a) one of said beads is disposed on the bottom rim of the side wall of the closure cap.

4. The invention as defined in claim 1, wherein:

(a) said closure cap has a finger-engageable lifting edge, to facilitate grasping the cap and prying it off the cap body.

5. The invention as defined in claim 1, wherein:

(a) the cap body has internal threads adapted to engage the external threads of a bottle neck, (b) said cap body further having a deformable sealing skirt of annular configuration, for engagement with the lip of the neck of the bottle, thereby preventing leakage of product from the interior of the container, past the threads.

6. The invention as defined in claim 1, wherein:

(a) said dome-shaped top wall has a sloping drain surface at its underside, for channeling liquid from the inner walls of the cap body toward the discharge opening when the dispenser is inverted, thereby to enable virtually complete emptying as the dispenser becomes depleted.

7. The invention as defined in claim 1, wherein:

(a) said discharge opening is constituted as a generally cylindrical bore, (b) the tip of said depending pin being generally conical and tapering from a cross dimension less than that of the diameter of said bore, to a sealing dimension substantially the same as the diameter of said bore, (c) said pin having a central cross-section portion characterized by said sealing dimension and having a generally cylindrical configuration, (d) the juncture of said conical portion and said cylindrical configuration defining a break, (e) the conical portion of said pin entering the bore first, and tending to force residual product therefrom, as the closure cap is swung from its discharge position to its sealing position, and the said central cross section portion of the pin being disposed in and substantially completely filling the said bore when the closure cap arrives at its sealing position so as to virtually completely clean out the bore of residual product and thus prevent the same from hardening and clogging the bore.

* * * * *